US007591278B1

(12) United States Patent
Kozlowski

(10) Patent No.: US 7,591,278 B1
(45) Date of Patent: Sep. 22, 2009

(54) SEWER SYSTEM VENT MONITOR

(76) Inventor: David Kozlowski, 560 Hoover St., Napa, CA (US) 94559

( * ) Notice: Subject to any disclaimer, the term of this patent is extended or adjusted under 35 U.S.C. 154(b) by 531 days.

(21) Appl. No.: 11/416,336

(22) Filed: May 2, 2006

(51) Int. Cl.
*F16K 13/10* (2006.01)

(52) U.S. Cl. ..... 137/253; 137/254; 137/559

(58) Field of Classification Search ..... 137/251.1, 137/253, 254, 559
See application file for complete search history.

(56) References Cited

U.S. PATENT DOCUMENTS 126,398 A * 5/1872 Kaempf ..... 137/251.1
473,961 A * 5/1892 Rhett ..... 137/251.1
994,645 A * 6/1911 Knapp ..... 137/254
1,461,404 A * 7/1923 Roth ..... 137/251.1
2,575,574 A * 11/1951 Withrow et al. ..... 137/251.1
2,747,601 A * 5/1956 Quist ..... 137/253
3,595,260 A * 7/1971 Lotzmann et al. ..... 137/251.1
4,411,286 A * 10/1983 Ball ..... 137/253
6,973,938 B2 * 12/2005 Mitchell ..... 137/251.1

* cited by examiner

*Primary Examiner*—John Rivell
(74) *Attorney, Agent, or Firm*—Thomas R. Lampe

(57) ABSTRACT

Apparatus incorporating a water trap allows vent air to flow into a sewer system under low pressure differential conditions and allows gaseous emissions from the sewer system to exit the vent pipe only under greater differential pressure conditions.

5 Claims, 5 Drawing Sheets

SEWER SYSTEM VENT MONITOR

TECHNICAL FIELD

This invention relates to apparatus for controlling the flow of air into a sewer system and for controlling gaseous emissions from the sewer system. The invention has particular, but not exclusive, application to oil refinery sewer systems.

BACKGROUND OF THE INVENTION

Vent pipes employed in connection with refinery sewer systems must draw air easily to prevent vacuum lock. Increasingly stringent environmental regulations have created a need for vent pipes to be sealed against evaporative pollution of the outside atmosphere. Refinery sewer systems employ a variety of ordinary water seals, such as S-traps, P-traps and other water seals in various locations of the sewer system. These arrangements are not for the purpose of venting air into the sewer system and, in fact, it is imperative that the typical water traps remain full of water to effectively prevent emissions from the sewer system into the ambient atmosphere. In the absence of a vent pipe or vent pipes elsewhere in the system, low pressure episodes in the sewer system can suck the water from the water traps and destroy the effectiveness insofar as gaseous emission prevention is concerned.

DISCLOSURE OF INVENTION

The apparatus of the present invention controls the flow of air into a sewer system and controls gaseous emissions from the sewer system. As will be seen below, sealing is accomplished through a water seal forming a water barrier stopping sewer gas from migrating unimpeded out of the vent pipe. On the other hand, the vent pipe is allowed to draw air easily, thus preventing formation of a strong vacuum condition within the sewer system that would suck water out of the conventional water seals at other locations of the sewer system such as a ground drain.

Unlike other water seals, such as S-traps, P-traps and other conventional arrangements, none of the water creating the water seal in the present apparatus is sucked down the drain into the sewer system when the apparatus admits air. Instead, water continues to reside in a container of the apparatus. Air entering the apparatus merely "bubbles" up through this water. Upon pressure equalization, the water seal immediately reestablishes itself.

Other advantages of the apparatus reside in its incorporation of structure allowing for ready monitoring of water seal level and venting activity as well as structure for replenishing water in the container when lost by evaporation or other causes.

The apparatus includes a first fluid conduit and a second fluid conduit.

The apparatus also includes a container defining a container interior for accommodating water, the first and second conduits being operatively connected to the container and respectively in fluid-flow communication with the container interior through spaced first and second openings.

Trap structure is in operative association with the container to form a water seal employing the water in the container interior resisting air and gaseous emissions flow between the first opening and the second opening.

Monitoring structure is provided for observing the water in the container interior and any air drawn into the water by a pressure drop in the sewer system.

Water replenishment structure is provided for introducing supplemental water into the container interior responsive to a drop in water level within the container interior.

Also, the apparatus incorporates structure which ensures that air is easily introduced into the sewer system responsive to a low pressure event in the sewer system. In contrast, venting of gaseous emissions from the sewer system into the ambient atmosphere is deterred.

Other features, advantages and objects of the present invention will become apparent with reference to the following description and accompanying drawings.

BEST MODE FOR CARRYING OUT THE INVENTION

Figure 6:
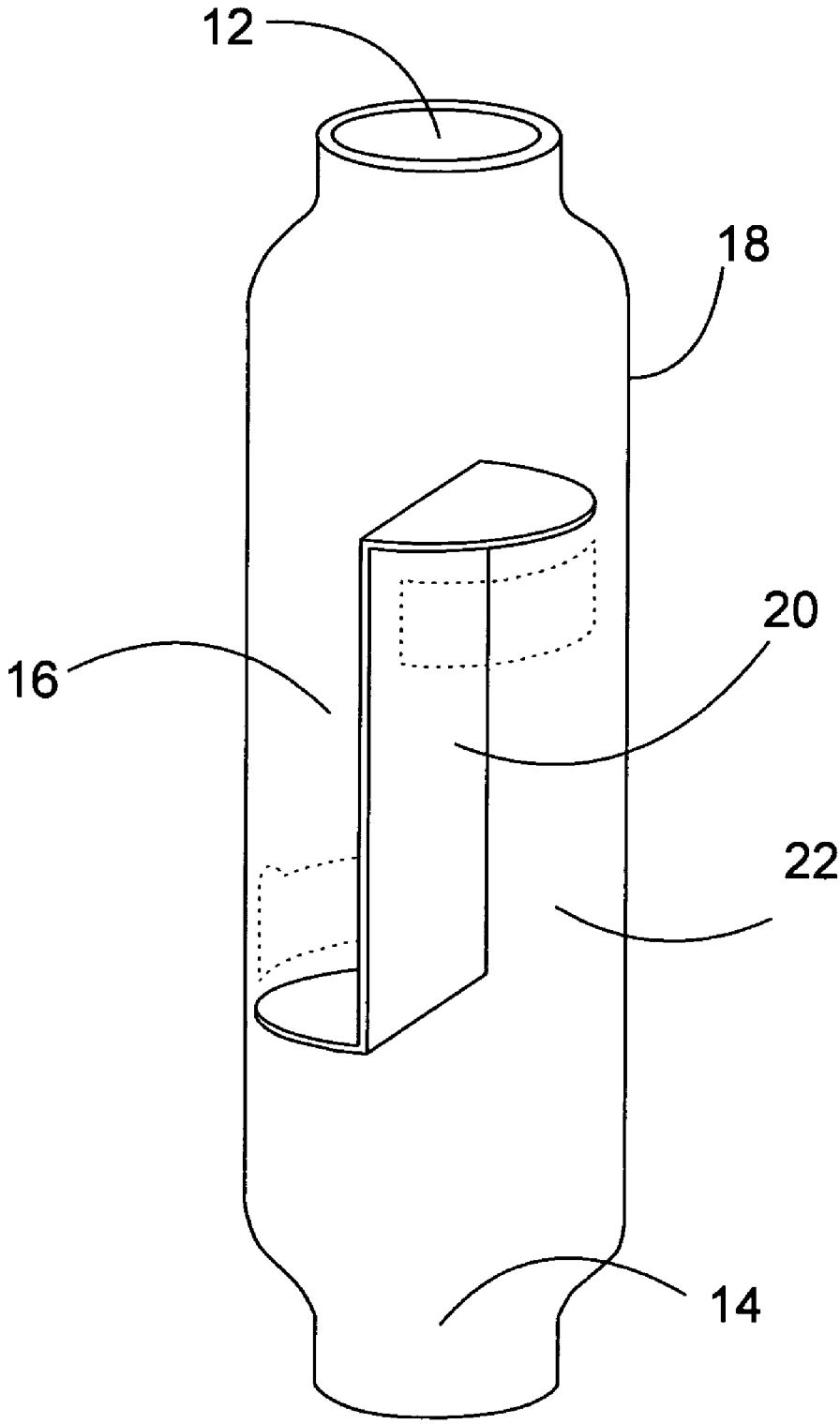
FIG. 6 is a perspective view showing a housing of the invention in cross-section with an interiorly disposed baffle dividing the housing into a rising and descending fluid conduit portions.

Referring now to the drawings, apparatus constructed in accordance with the teachings of the present invention includes a fluid conduit 12 comprising the upper leg of a vent pipe having an upper end in communication with the ambient atmosphere. The apparatus also includes a fluid conduit 14 leading downwardly to a sewer system, such as a refinery sewer system (not shown), comprising the lower leg of the vent pipe. The lower end of the fluid conduit 12 is comprised of a portion 16 of a housing 18. A solid baffle 20 (see FIG. 6) divides the housing interior into portion 16 and a portion 22 which comprises the upper end of conduit pipe 14, the separation between portions 16 and 22 being complete in housing 18.

A container in the form of a water box 26 is attached to the housing 18 and defines a container interior for accommodating water. The conduits 12 and 14 are in fluid-flow communication with the interior of the container 26 through slot-like openings 28, 30, respectively, providing communication between the housing and container interiors. Opening 28 is in communication with conduit 12 through portion 16 thereof defined by the housing 18 and baffle 20. The portion 22 of descending conduit 14 is in communication with the interior of the container 26 through opening 30.

Figure 1:
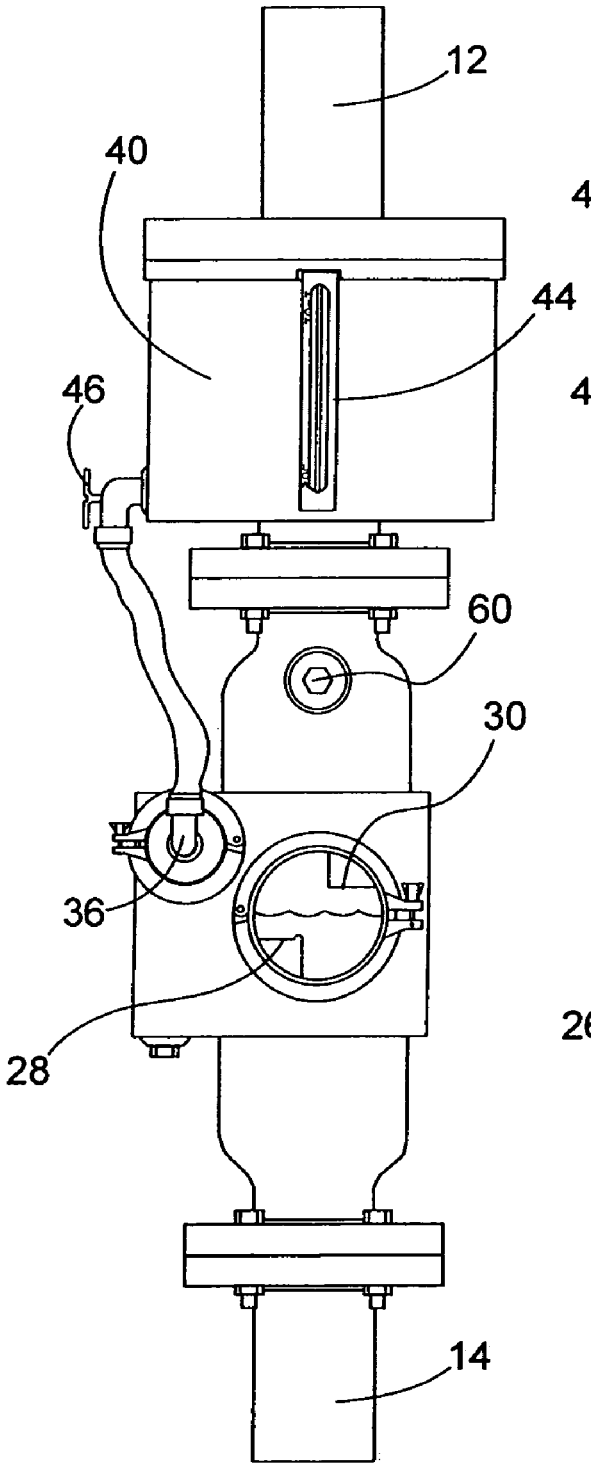
FIG. 1 is a frontal, perspective view of apparatus constructed in accordance with the teachings of the present invention.
Figure 2:
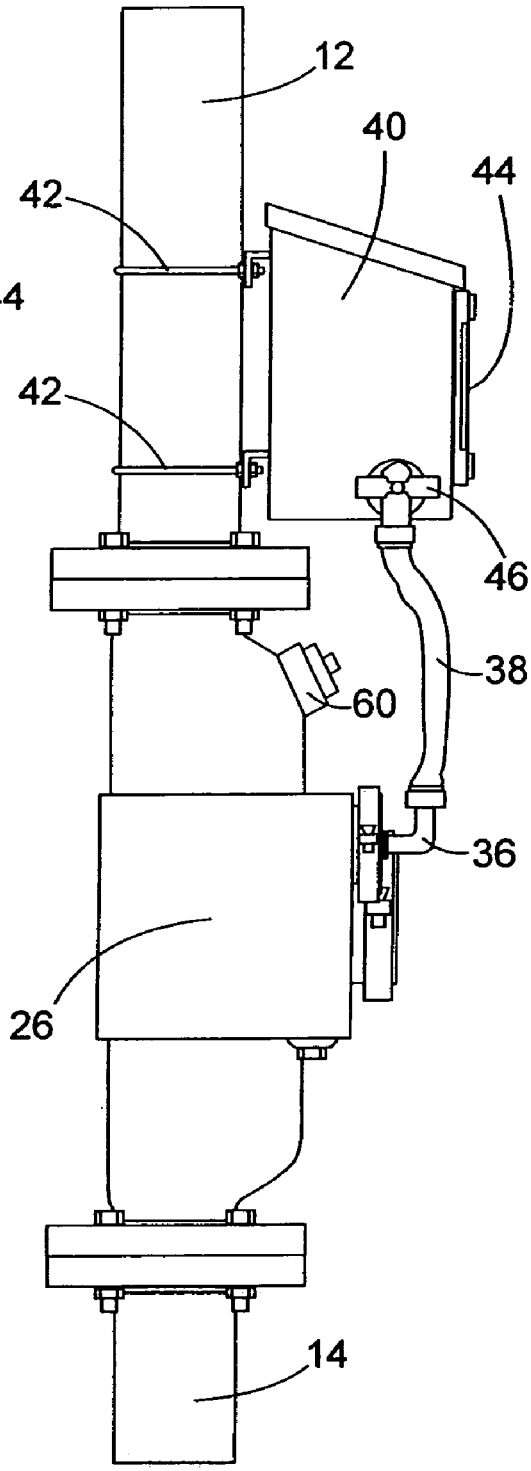
FIG. 2 is a side, elevational view of the apparatus.
Figure 3:
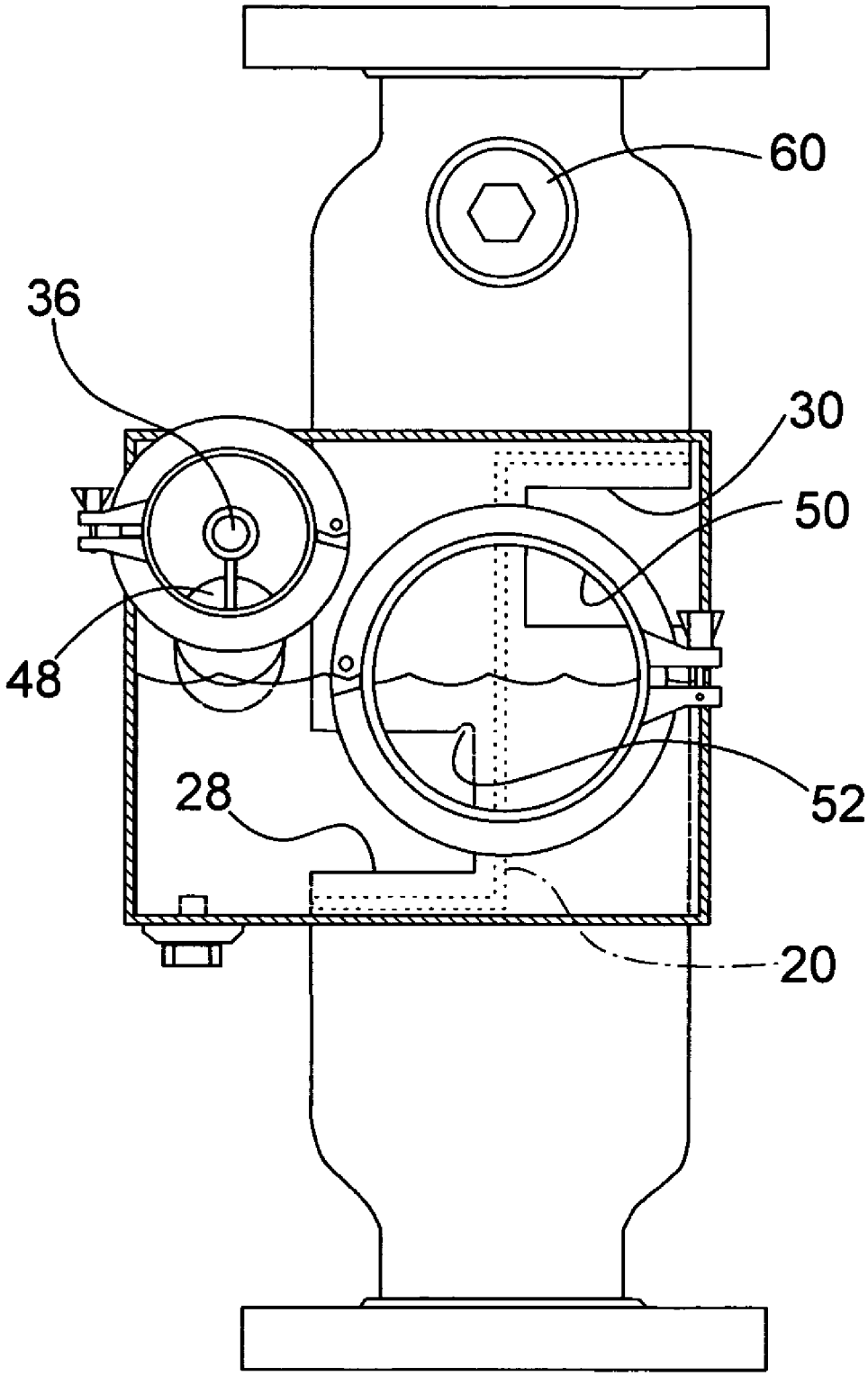
FIG. 3 is a front, elevational view of selected structure of the apparatus, a portion of which is designated in cross-section.
Figure 4:
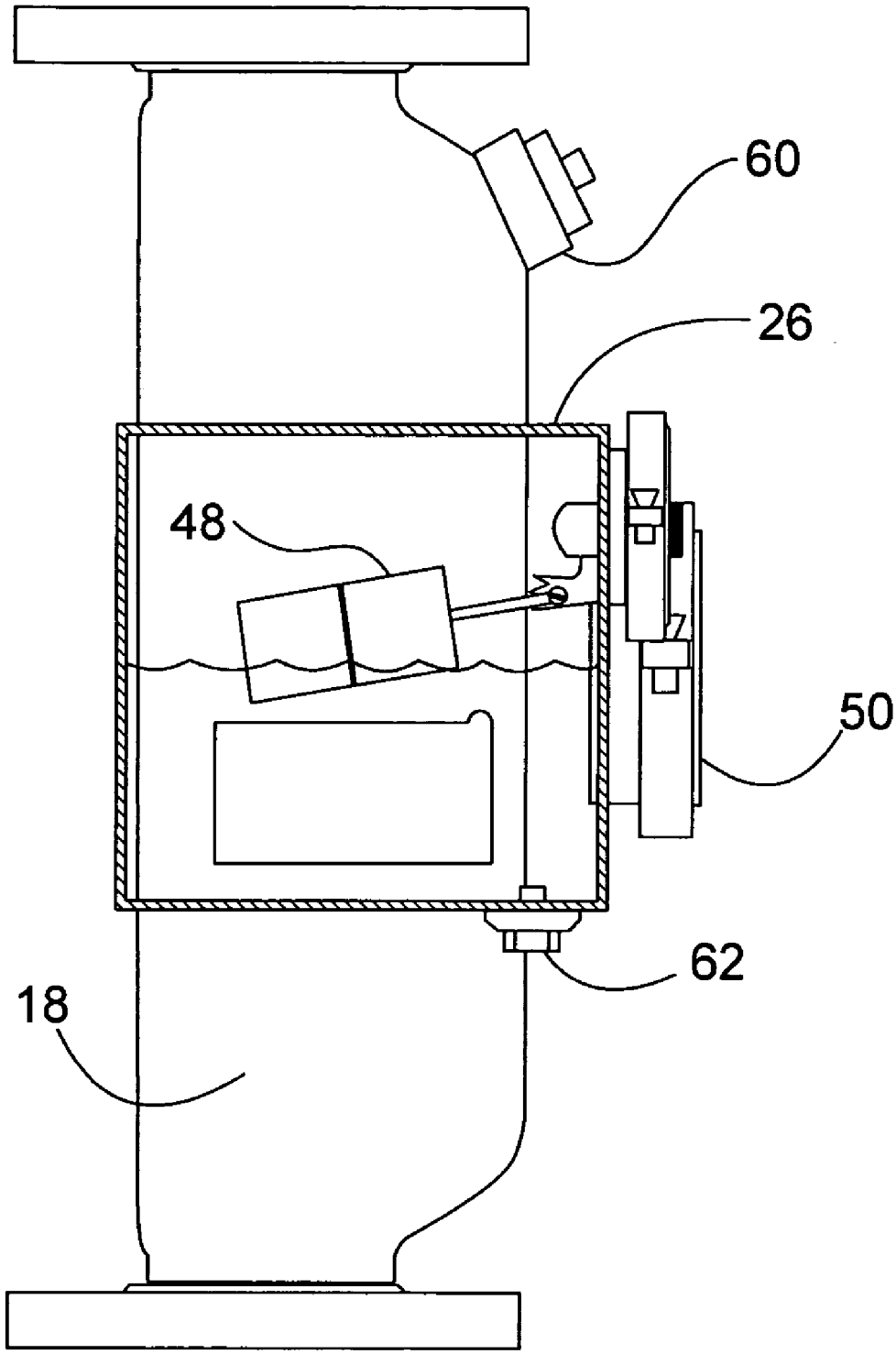
FIG. 4 is a side, elevational view of the structure illustrated in FIG. 3, a portion of which is in cross-section.
Figure 5:
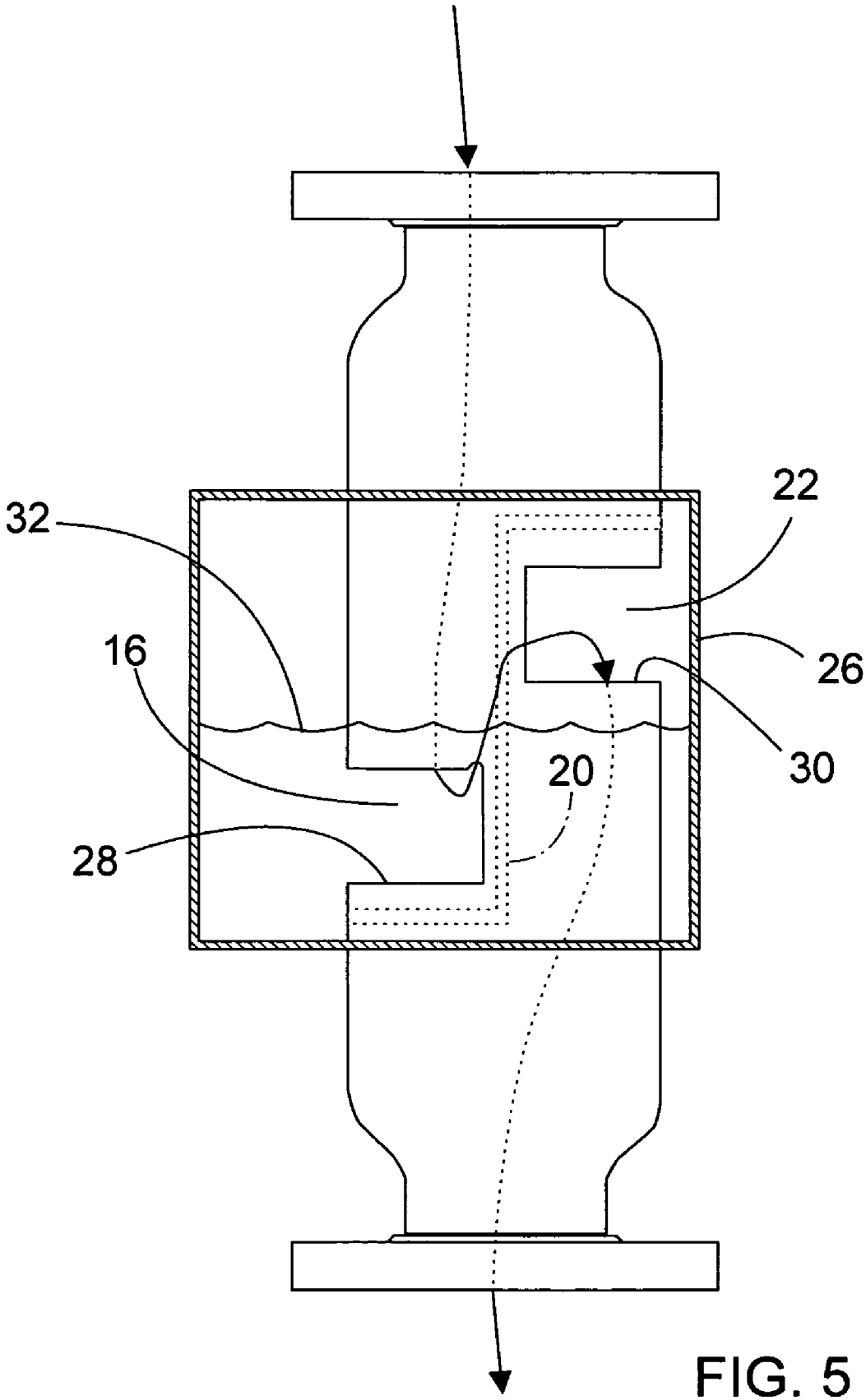
FIG. 5 is a diagrammatic presentation of the structure of FIGS. 4 and 5 showing the interior of a container and associated water trap and the flow of venting air therethrough.

The structure just recited constitutes a trap structure in operative association with the container to form a water seal employing the water in the container interior resisting air and gaseous emissions flow between openings 28 and 30. When a low pressure event takes place in the sewer system, air will be drawn downwardly through the conduit 12 through opening 28 (which is below the surface level of the water 32 in the water box) and thence will proceed through opening 30 and downwardly into the sewer system through conduit 14. This is shown in diagrammatic fashion by the flow line incorporating the arrows in FIG. 5.

On the other hand, pressurized gas emissions produced by the sewer system will flow in the opposite direction along the flow path; that is, the gaseous emissions will flow upwardly through conduit 14 into container 26 through opening 30, and upon downward displacement of the water through opening 28 and thence upwardly through the conduit 12.

Water replenishment structure is provided for introducing supplemental water into the interior of the water box responsive to a drop in water level within the container interior. As seen in the drawings, the water level is normally positioned between the two openings 28 and 30 to ensure proper operation of the water trap, the top of opening 28 being below the level of the bottom of opening 30.

The water replenishment structure includes a water inlet 36 communicating with the interior of the water box 26. A hose or other form of conduit 38 leads to a water vessel 40 used to hold a supply of replenishment water. The water vessel 40 in this embodiment of the invention is connected to conduit 12 by brackets or U-bolts 42 and disposed above the container 26 so that water will flow from the water vessel to the interior of the container under the influence of gravity. A shut off valve 46 is preferably incorporated in the structure to allow manual shut off of the replenishment water supply if desired. A supplemental water level indicator 44 is utilized to observe the level of supplemental water in the water vessel 40. A displaceable top lid is provided to allow the water box to be filled.

A float valve 48 is operatively associated with the inlet 36 to establish fluid-flow communication between the water inlet and the interior of the container when the water level in the container drops below a predetermined level. The float valve also operates to terminate fluid-flow communication between the water inlet and the container interior when the water level in the container interior rises to or above the predetermined level. An observation or sight window 50 is formed in the container to monitor or observe the water in the container interior as well as any air drawn into the water 32 due to a pressure drop in the sewer system.

It is to be noted that the opening 28 includes an upwardly projecting notch 52 at an upper corner thereof. This notch may be readily observed through the observation window 50. Air entering the container interior from the vent pipe 12 as a result of a low pressure event in the sewer system will pass through notch 52 and form a readily observable air bubble stream rising upwardly from the notch through water 32.

In the arrangement illustrated, regulatory testing of the air above the water seal, if necessary, can be accomplished by removal of a testing plug 60. A drain plug 62 may be employed if desired.

For proper operation of the apparatus, it is important that the lower end of fluid conduit 12 have an interior cross-section substantially smaller than the cross-section of the water box interior. This provides a hydraulic advantage to the apparatus whereby any water in the vent pipe pushed a distance down in the vent pipe by atmospheric pressure due to a low pressure event in the sewer system will cause the level of water in the water box interior to rise just a fraction of that distance. Furthermore, the water in the container interior when pushed downwardly by a high pressure event in the sewer system will escape into the lower end of the fluid conduit 12 and rise at a higher rate in the vent pipe than the rate of lowering of water in the container interior caused by the high pressure event. This structure results in a greater pressure deferential being required to allow air and gaseous emissions to escape from the container interior than to draw atmospheric air into the container interior from the vent pipe 12. The apparatus provides an effective emission gas seal while allowing air to be drawn easily into the sewer system. This prevents formation in the sewer system of a strong vacuum condition which would suck water out of the water seals in ground drains and the like.

Unlike ordinary water seals, none of the water creating the water seal drains to the sewer when atmospheric air is admitted to the sewer. Instead the water continues to reside in the water containment box. Air entering the system merely "bubbles" up through the water. Upon pressure equalization, the water seal immediately reestablishes itself.

If air bubbles can be seen rising through the observation window or sight glass, air is entering the sewer system. The bubbles are not indicative of air escaping from the system into the outside atmosphere. The bubbles are merely being formed as air is being sucked down the vent pipe, bubbling up through the internal water seal of the apparatus and continuing on down into the sewer system.

The invention claimed is:

1. Apparatus for controlling the flow of air into a sewer system and for controlling gaseous emissions from the sewer system, said apparatus comprising, in combination:

a first fluid conduit comprising the upper leg of a vent pipe in communication with the ambient atmosphere and having a lower end;

a second fluid conduit comprising the lower leg of said vent pipe leading to a sewer system and having an upper end, the lower end of the first fluid conduit and the upper end of the second fluid conduit respectively comprising first and second portions of a housing;

a container comprising a water box attached to said housing and defining a container interior at least partially surrounding said housing for accommodating water, said first and second fluid conduits being operatively connected to said container and respectively in fluid-flow communication with said container interior through spaced first and second openings in said housing, said first opening being at a lower elevation than said second opening to form a water seal employing water in said container interior resisting air and gaseous emissions flow between said first opening and said second opening, said vent pipe having an interior cross-section substantially smaller than the cross-section of said container interior to provide a hydraulic advantage to the apparatus whereby any water in the vent pipe pushed a distance down in the vent pipe by atmospheric pressure due to a low pressure event in the sewer system will cause the level of water in the container interior to rise a fraction of said distance and whereby the water in the container interior when pushed downwardly by a high pressure event in the sewer system will escape into the vent pipe and rise at a higher rate in the vent pipe than the rate of lowering of water in the container interior caused by said high pressure event, resulting in a greater pressure differential being required to allow air to escape from said container interior than to draw air into said container interior from said vent pipe.

2. The apparatus according to claim 1 wherein said second opening is positioned at a height sufficient to prevent water from exiting said container interior through said second opening into said second fluid conduit and into said sewer system when the low pressure event in the sewer system causes air to enter said container interior.

3. Apparatus for controlling the flow of air into a sewer system and for controlling gaseous emissions from the sewer system, said apparatus comprising, in combination:

a first fluid conduit;

a second fluid conduit;

a container defining a container interior for accommodating water, said first and second conduits being operatively connected to said container and respectively in fluid-flow communication with said container interior through spaced first and second openings;

trap structure in operative association with said container to form a water seal employing the water in said container interior resisting air and gaseous emissions flow between said first opening and said second opening; and water replenishment structure for introducing supplemental water into said container interior responsive to a drop in water level within said container interior, said water replenishment structure including a water inlet communicating with said container interior and a water valve for establishing fluid-flow communication between said water inlet and said container interior when the water level in said container interior drops below a predetermined level and for terminating fluid-flow communication between said water inlet and said container interior when the water level in said container interior rises to or above said predetermined level, said water replenishment structure additionally including a water vessel defining a water vessel interior for holding a supply of said supplemental water and a water supply conduit between said water vessel and said water valve, said water vessel elevated relative to said water container, and said first conduit being a vent pipe extending upwardly from said container, said water vessel being supported by said vent pipe.

4. The apparatus according to claim 3 additionally including a supplemental water level indicator operatively associated with said water vessel.

5. Apparatus for controlling the flow of air into a sewer system and for controlling gaseous emissions from the sewer system, said apparatus comprising, in combination:

a first fluid conduit;

a second fluid conduit;

a container defining a container interior for accommodating water, said first and second fluid conduits being operatively connected to said container and respectively in fluid-flow communication with said container interior through spaced first and second openings;

trap structure in operative association with said container to form a water seal employing the water in said container interior resisting air and gaseous emissions flow between said first opening and said second opening, said first opening being disposed at a lower elevation than said second opening and said first fluid conduit comprising an upwardly extending vent pipe in communication with the ambient atmosphere, said vent pipe having an interior cross-section substantially smaller than the cross-section of said container interior to provide a hydraulic advantage to the apparatus whereby any water in the vent pipe pushed a distance down in the vent pipe by atmospheric pressure due to a low pressure event in the sewer system will cause the level of water in the container interior to rise a fraction of said distance and whereby the water in the container interior when pushed downwardly by a high pressure event in the sewer system will escape into the vent pipe and rise at a higher rate in the vent pipe than the rate of lowering of water in the container interior caused by said high pressure event, resulting in a greater pressure differential being required to allow air to escape from said container interior than to draw air into said container interior from said vent pipe, said first opening including an upwardly projecting notch for causing air entering said container interior from said vent pipe to form an air bubble stream rising upwardly from said notch through the water in said container interior; and an observation window for observing said air bubble stream.

* * * * *